US009976545B2

(12) United States Patent
Glauber et al.

(10) Patent No.: US 9,976,545 B2
(45) Date of Patent: May 22, 2018

(54) AIR OPERATED PUMP

(71) Applicant: WILDEN PUMP AND ENGINEERING LLC, Grand Terrace, CA (US)

(72) Inventors: Carl Glauber, Mission Viejo (JP); Greg S. Duncan, Huntington Beach, CA (US)

(73) Assignee: WILDEN PUMP AND ENGINEERING LLC, Grand Terrace, CA (US)

( * ) Notice: Subject to any disclaimer, the term of this patent is extended or adjusted under 35 U.S.C. 154(b) by 618 days.

(21) Appl. No.: 14/609,236

(22) Filed: Jan. 29, 2015

(65) Prior Publication Data

US 2015/0219089 A1 Aug. 6, 2015

Related U.S. Application Data

(60) Provisional application No. 61/934,563, filed on Jan. 31, 2014.

(51) Int. Cl.
*F04B 43/073* (2006.01)
*F04B 15/02* (2006.01)

(52) U.S. Cl.
CPC ..... *F04B 43/0733* (2013.01); *F04B 15/02* (2013.01); *F04B 43/0736* (2013.01)

(58) Field of Classification Search
CPC ..... F04B 43/073; F04B 43/0733; F04B 43/0736; F04B 15/02
USPC ..... 417/46, 395
See application file for complete search history.

(56) References Cited

U.S. PATENT DOCUMENTS 4,158,530 A 6/1979 Bernstein
4,247,264 A 1/1981 Wilden
4,549,467 A 10/1985 Wilden et al.
5,007,803 A * 4/1991 DiVito ..... F04F 1/02 417/137
5,147,182 A * 9/1992 Timmons ..... F04B 43/113 417/234

(Continued)

FOREIGN PATENT DOCUMENTS

DE 19736703 A1 * 3/1999 ..... F16K 7/07
DE 102006048454 B3 * 11/2007 ..... F16K 7/07

OTHER PUBLICATIONS

International Search Report dated Sep. 11, 2015, PCT/US15/13685—Jan. 30, 2015.

*Primary Examiner* — Dominick L Plakkoottam
*Assistant Examiner* — Chirag Jariwala
(74) *Attorney, Agent, or Firm* — Karish & Bjorgum, PC

(57) ABSTRACT

An elongate air operated pump includes a pump chamber, a bladder inside the pump chamber, inlet and outlet valves to and from the chamber and an air control system. The air control system includes a control valve alternately communicating compressed air and exhaust to atmosphere to a venturi with a first end, a second end and a throat port. The first end of the venturi receives continuous compressed air. The second end receives the alternately communication of compressed air and exhaust to atmosphere from the control valve. The throat port of the venturi is in continuous communication with the bladder to pressurize and draw a vacuum on the bladder. The valves may be pneumatic pinch valves controlled by the control valve to cycle with the bladder or passive one-way pump valves.

19 Claims, 11 Drawing Sheets

(56) References Cited

U.S. PATENT DOCUMENTS

| | | | | |
|---|---|---|---|---|
| 5,169,296 | A | 12/1992 | Wilden | |
| 5,378,122 | A | 1/1995 | Duncan | |
| 5,957,670 | A | 9/1999 | Duncan et al. | |
| 6,102,363 | A | 8/2000 | Eberwein | |
| 6,257,845 | B1 | 7/2001 | Jack et al. | |
| 6,357,723 | B2 | 3/2002 | Kennedy et al. | |
| 6,435,845 | B1 | 8/2002 | Kennedy et al. | |
| 7,063,516 | B2 | 6/2006 | Bethel | |
| 7,125,229 | B2 | 10/2006 | Distaso et al. | |
| 7,399,168 | B1 | 7/2008 | Eberwein | |
| 7,452,166 | B2 * | 11/2008 | von Keudell | B05B 7/1459 406/137 |
| 7,517,199 | B2 | 4/2009 | Reed et al. | |
| 8,231,310 | B2 * | 7/2012 | Sanwald | B05B 7/1459 406/127 |
| 2007/0122291 | A1 * | 5/2007 | Okumura | F04B 49/08 417/46 |

* cited by examiner

AIR OPERATED PUMP

RELATED APPLICATIONS

The present application claims priority from U.S. Provisional Application No. 61/934,563, filed Jan. 31, 2014, the disclosure of which is incorporated herein by reference in its entirety.

BACKGROUND OF THE INVENTION

The field of the present invention is air operated pumps. U.S. Pat. Nos. 7,399,168; 7,063,516; 6,435,845; 6,357,723; 6,257,845; 5,957,670; 5,169,296; 4,247,264 disclose air driven and air controlled pumps. Various one-way valves for pumped medium are disclosed in these patents. Actuator valves used in such pumps are also disclosed in the foregoing and are specifically addressed in U.S. Pat. Nos. 7,125,229; 6,102,363; 4,549,467. The air valves for these pumps operate using a pilot valve system that senses pump position and initiates shifting of the pump through a directional control valve. U.S. Pat. No. 5,378,122 discloses an air driven pump which is controlled by a solenoid that times shifts independently of the position of the pump in its cycle. U.S. Pat. No. 7,517,199 discloses an air driven pump which is controlled by an electronic controller.

SUMMARY OF THE INVENTION

The invention is directed to an air operated pump using compressed air to draw fluid medium through an pump chamber having an inlet and an outlet. The pump chamber includes a bladder and valves to either side of the bladder. A control valve provides communication to a venturi alternating between a source of compressed air and an exhaust to atmosphere. The venturi is in communication with the control valve, the source of compressed air and the bladder to both contract and expand the bladder using compressed air.

Various combinations of the following embodiments are contemplated. Such elongate chamber pumps may find specific utility in drawing pumped medium upwardly through limited access such as a small access port or ports. Albeit quite widely applicable, the pumps can find specific utility in pumping viscos materials hard to draw through a tube. They also find advantage under conditions where all air driven pumps offer reliability, safety and convenience. A principle object of the invention is to provide an elongate pumping mechanism. Other and further objects and advantages will appear hereinafter.

All variations of the preferred embodiments are driven through control valves that are the same. The pneumatic systems for the inlet chambers into the elongate pumps are also the same. Pneumatic valves and one-way valves are disclosed for use in the elongate pump chambers. The bladder may take on various configurations.

Of possible pneumatic valves, pinch valves are disclosed in the preferred embodiments. In this arrangement, the control valve is in communication with a pinch valve downstream of a bladder as well as the venturi; and the throat port of the venturi is both in communication with the bladder and a pinch valve upstream of the bladder. Further, the communication between the venturi throat port and the bladder may be restricted such that the operation of the bladder occurs more slowly than the operation of the upstream pinch valve to minimize flow back through the closing upstream pinch valve. The control valve alternates between the supply of compressed air and exhausting to atmosphere. A third position between these two extremes may be employed where all components are pressurized during the shifting of the control valve.

In a variation of the embodiments with pinch valves or one-way valves, the elongate pump chamber may be duplicated in series; and each successive chamber segment is driven at 180° out of phase with the prior chamber segment. Further, the pinch valves and bladders may be made of equal length such that a different effect is achieved as each of these elements then alternates in function between a pinch valve and a bladder as pressure and release alternate through the elongate pump chamber.

The same control valve may also drive more than one pump chamber. With two pump chambers, two venturi may be similarly coupled to the control valve, to the source of compressed air and to the bladders. The chambers may be arranged and controlled with the bladders alternating to provide a more continuous flow. In this instance, the coupling of the second chamber with the control valve is reversed.

DETAILED DESCRIPTION OF THE PREFERRED EMBODIMENTS

Figure 1:
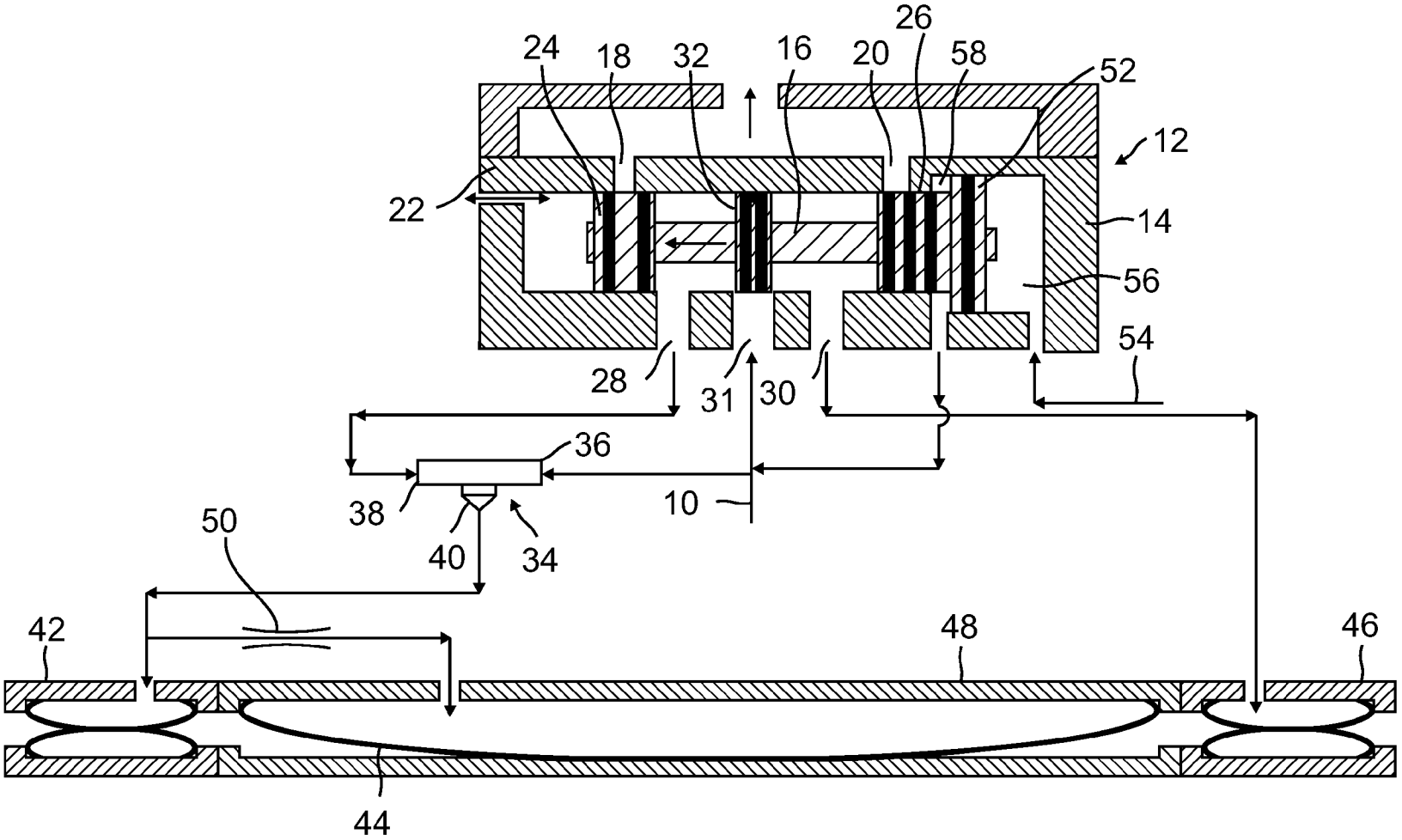
FIGS. 1 through 5 are schematic representations in sequential operation of an air operated pump.

Looking to FIGS. 1 through 5, a source of compressed air 10 is directed to a control valve 12. The control valve 12 includes a housing 14 and a valve spool 16. The housing 14 defines a valve cylinder 22 within which the valve spool 16 translates. There are two vents 18, 20 from the cylinder 22 through a muffler. In various embodiments, the vents 18, 20 may be separately directed to atmosphere or directed through a common passage. These configurations for the venting to atmosphere are collectively referred to as an exhaust to atmosphere. The valve spool 16 includes two outer lands 24, 26 with seals around each, as shown in the Figures, to prevent unintended axial flow. The two outer lands 24, 26 of the valve spool 16 control the vents 18, 20. Two valve ports 28, 30 are in communication with the pump components and have an inlet port 31 from the source of compressed air 10 therebetween. A center land 32 on the valve spool 16 controls compressed air from the source of compressed air 10 for distribution to the valve ports 28, 30. The center land 32 also has seals therearound, as shown in the Figures, to prevent unintended axial flow. However, the center land 32 may be narrower than the inlet port 31 between the valve ports 28, 30 such that the source of compressed air 10 is in communication with both of the valve ports 28 and 30 momentarily during shifting.

The pneumatic system for the elongate pump includes a venturi 34 having an inlet end 36, an outlet end 38 and a venturi throat port 40. The venturi 34 is in communication with the source of compressed air 10 at the inlet end 36 and in communication with the control valve 12 through the controlled valve port 28 at the outlet end 38. The venturi 34 is in communication with an upstream pinch valve 42 and a bladder 44 of the pumping unit through the venturi throat port 40. Finally, the control valve 12 is in communication with a downstream pinch valve 46 through the controlled valve port 30.

The pumping unit includes an elongate pump chamber 48 with the upstream pinch valve 42. The downstream pinch valve 46 is displaced from the upstream pinch valve 42 to provide a cavity therebetween for the bladder 44. The valves 42 and 46 may also be air driven valves other than pinch valves to open and close the inlet and the outlet to the elongate pump chamber 48. A restriction 50 is located in the communication between the venturi throat port 40 and the cavity defined by the bladder 44. The bladder(s) 44 may take on any configuration to effect a variable volume within and allow flow through the chamber 48. Compare the embodiment of FIG. 11 with the remaining figures. The bladder 44 provides a resilient, movable wall sealing the air side of the chamber 48 from the pump side of the chamber 48.

A piston 52 attached at one end of the valve spool 16 moves the valve spool 16 in shifting from end to end of the valve 12. An external air source 54 alternating between pressure and exhaust is in communication with a cavity 56 on one side of the piston 52 while a cavity 58 on the other side of the piston 52 is in communication with the source of compressed air 10. The pressure area on the outer side of the piston 52 open to cavity 56 is larger than the annular pressure area on the inner side of the piston 52 open to cavity 58. Therefore, with the far end of the valve spool 16 open to atmosphere, the pressure supplied by external air source 54 can be equal to the source of compressed air 10. This pneumatic mechanism for driving the control valve may alternatively include a solenoid actuated valve spool 16 driven by a timer or controller.

Figure 2:
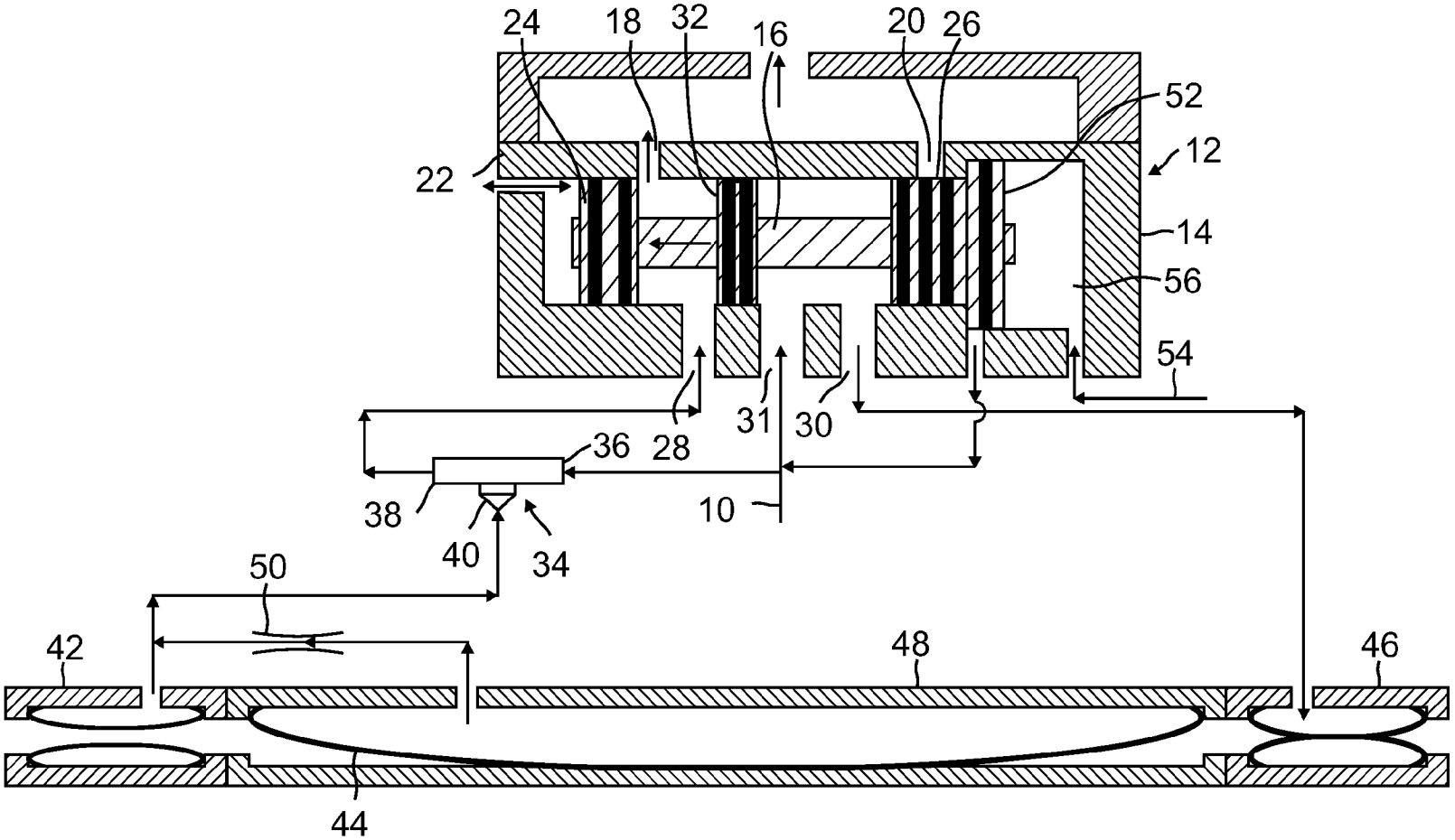

Turning to the operation of the pump in FIGS. 1 through 5, FIG. 1 shows a first shifting of the spool 16 to open the valve port 28 to a vent 18 as seen in FIG. 2. During this period of transition of the control valve 12 illustrated in FIG. 1, compressed air is in communication with both pinch valves 42, 46 and the bladder 44 as the center land 32 is narrower than the inlet port 31.

With the valve 12 fully shifted as seen in FIG. 2, the valve port 28 is in communication with the vent port 18. As the venturi 34 has compressed air flowing from the source of compressed air 10 through the ends 36, 38 and to atmosphere through the valve port 28 and the vent 18, pressure is reduced at the venturi throat port 40. This draws a vacuum on the upstream pinch valve 42 and the bladder 44. The pinch valve 42 opens to allow fluid to flow into the pump through the inlet in the elongate pump chamber 48. At the same time, the bladder 44 is contracted to draw fluid into the elongate pump chamber 48. With the restriction 50 in the communication between the throat port 40 and the bladder 44, the upstream pinch valve 42 is fully open before the contraction of the bladder 44 for expansion of the elongate pump chamber 48. The source of compressed air 10 is directed through the valve port 30 to the pinch valve 46 such that it remains closed.

Figure 3:
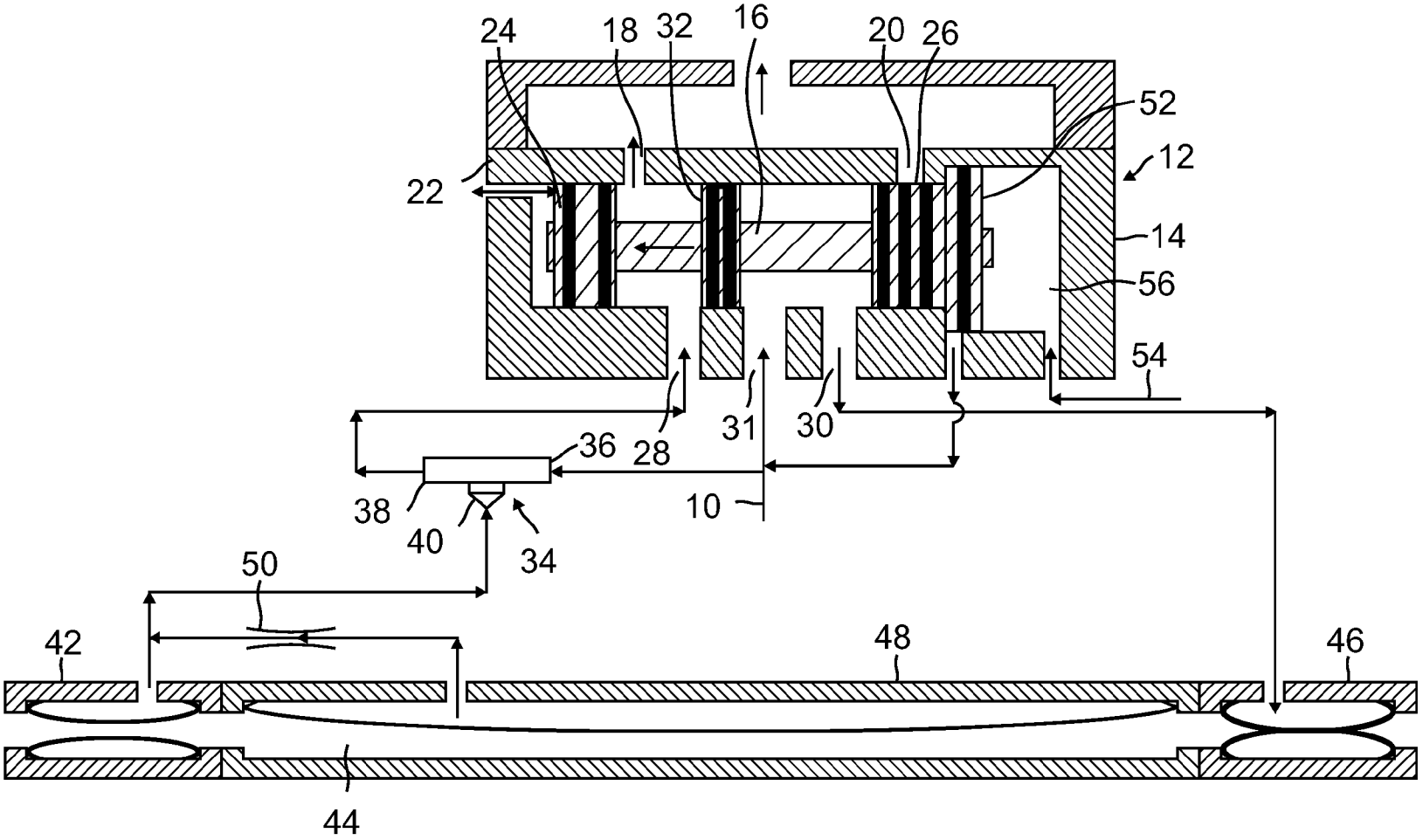
Figure 4:
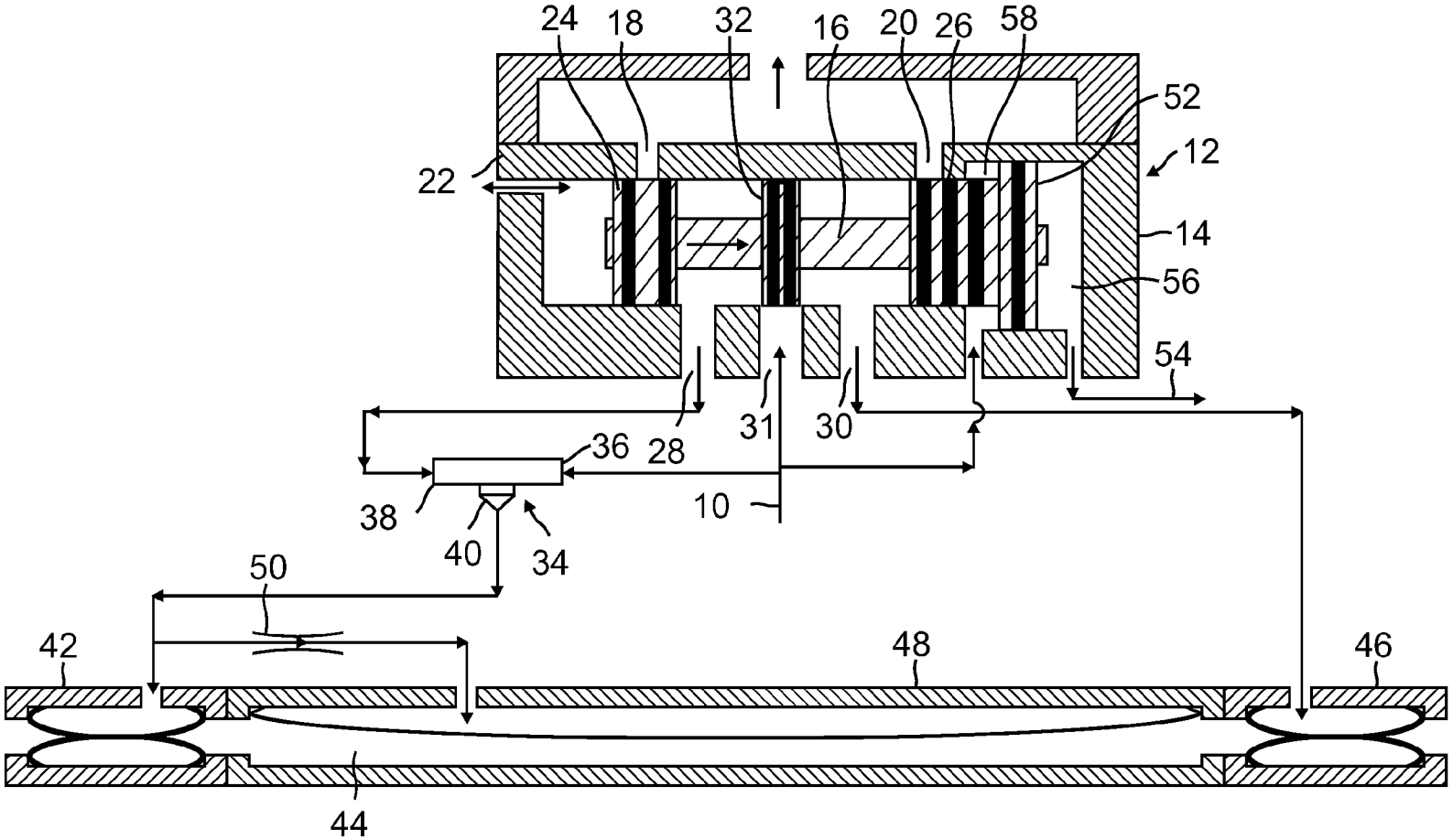

Once the bladder 44 has had time to contract, as illustrated in FIG. 3, the control valve 12 is shifted, passing through the intermediate position illustrated in FIG. 4. The shifting of the spool 16 is caused by venting the external air source 54. As can be seen in FIG. 4 with movement of the spool 16 in the direction of the arrow, the vent 20 remains closed, the vent 18 has just closed and compressed air from the source of compressed air 10 is in communication with the venturi 36 at its end 38 and with the pinch valve 46. The source of compressed air 10 is in communication with the end 38 of the venturi 36 and the pinch valve 46 because the center land 32 is narrower than the width of the inlet port 31, as noted above. In this position with compressed air now routed to the end 38 of the venturi 34 and constantly supplied to the other end 36 of the venturi 34, flow through the neck of the venturi 34 is reduced or eliminated. This allows compressed air to flow through the throat port 40 to pressurize the pinch valve 42. Thus, the pinch valve 42 closes, the pinch valve 46 remains closed and the bladder 44 begins to inflate. With the control valve 12 in the position illustrated in FIG. 4, the filling of the pinch valve 42 momentarily leads the exhausting of the pinch valve 46. The filling of the bladder 44 trails this closure of the pinch valve 42 because of the restriction 50 in the supply to the bladder 44.

Figure 5:
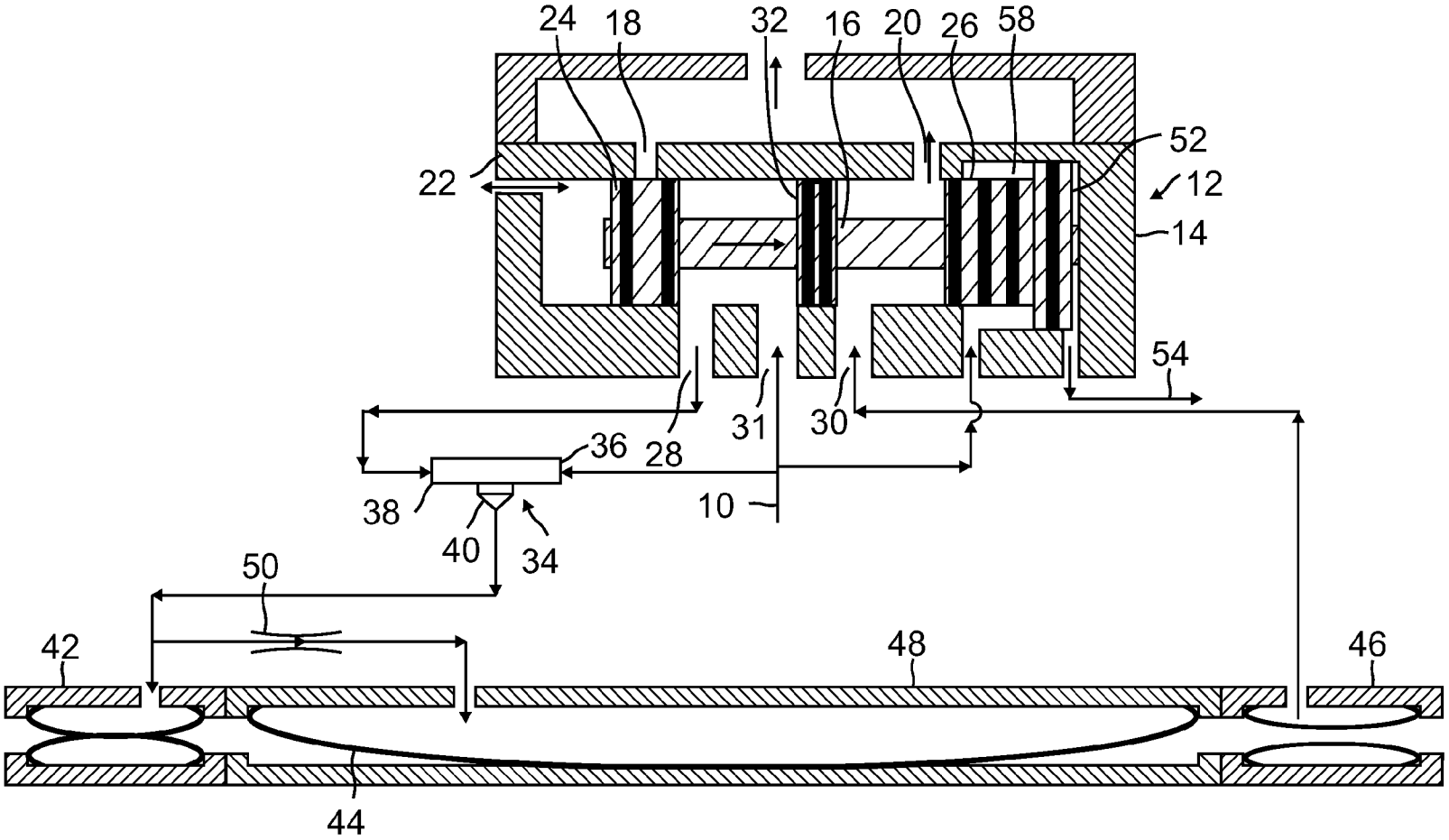

The control valve 12 is shown fully shifted in FIG. 5. In this position, compressed air from the source of compressed air 10 continues to flow through the throat port 40 to maintain the upstream pinch valve 42 closed. The bladder 44 expands. In fully shifting from the position in FIG. 4, the control valve 12 opens the valve port 30 to the vent 20 to allow the downstream pinch valve 46 to collapse to its relaxed, open state. With the pinch valve 46 open, fluid in the elongate pump chamber 48 is expelled. The external air source 54 is then cycled to provide air to the piston cavity 56 to again shift the control valve 12 in a second cycle.

Figure 6:
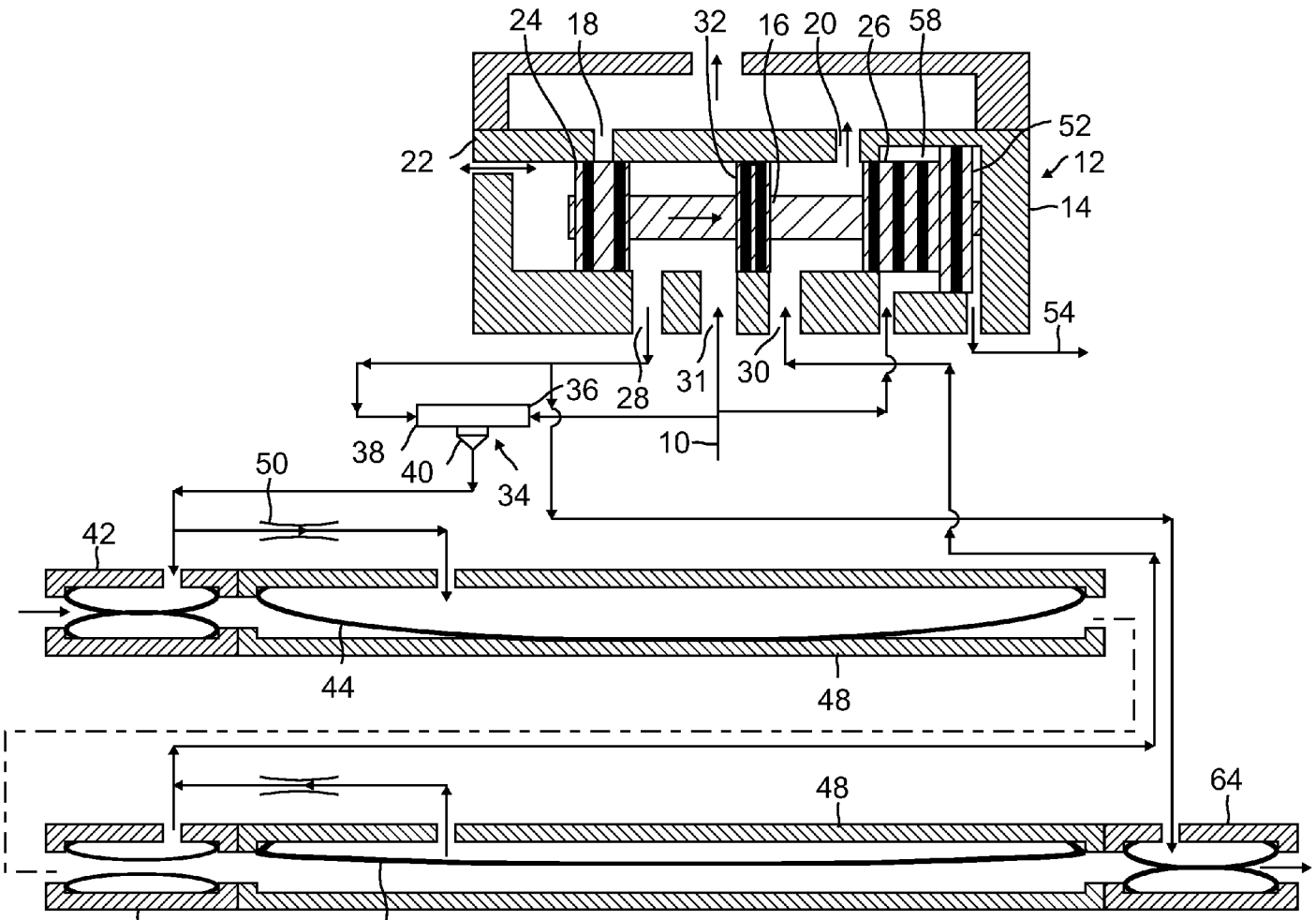
FIG. 6 is a schematic representation of an air operated pump as in FIGS. 1 through 5 with two chambers in series, the dotted line indicating a continuation of the elongate pump chamber.

FIG. 6 illustrates the valve mechanism of FIGS. 1 through 5 with the elongate pump chamber 48 being subdivided in series. A venturi 34 is used for the entry bladder 44 and the inlet pinch valve 42. The downstream pinch valve 46 is now located in the middle of the pump chamber 48. A downstream bladder 62 and a further downstream pinch valve 64 are located at the outlet section of the pump chamber 48. The inlet pinch valve 42, the inlet bladder 44 and the downstream pinch valve 46, now located at the inlet section of the pump chamber 48, perform as in FIGS. 1 through 5.

The downstream bladder 62 does not need to draw pumped fluid into the outlet section of the pump chamber 48 using reduced pressure generated by the venturi 34 under normal operating circumstances. Rather, the expansion of the inlet bladder 44 with the inlet pinch valve 42 closed and the downstream pinch valve 46 open forces the pumped fluid, which had previously been drawn into the inlet section of the pump chamber 48, into the outlet section of the pump chamber 48. The downstream bladder 62 is open to vent through the valve port 30 as the bladder 44 is pressurized through valve port 28 to provide room for the incoming pumped fluid to the outlet section.

As the pumped fluid is forced into the outlet section of the pump chamber 48, the further downstream pinch valve 64 remains closed. Once the outlet section of the pump chamber 48 is charged, the valve spool 16 shifts to close the downstream pinch valve 46, open the further downstream pinch valve 64 and pressurize the downstream bladder 62. Pumped fluid flows from the pump chamber 48 as the downstream bladder 62 is pressurized. As noted above, the center land 32 is narrower than the inlet port 31 in the control valve 12. Thus, all pinch valves 42, 46, 64 are closed by pressure for an instant during the shifting of the control valve 12. This reduces backflow through the pump chamber 48 during shifting of the valve spool 16.

The series can be repeated for more than two sections of the chamber 48 with each succeeding section in the series operating at 180° out of phase with the prior section. Only the inlet section employs the venturi 34. Alternatively, the pinch valves and bladders may be made of equal length such that a different effect is achieved. When of equal length, each of these elements then alternates in function between a pinch valve and a bladder as pressure and vent to atmosphere alternate through the elongate pump chamber 48. Only the second element from the inlet is preferably subject to vacuum to draw pumped fluid into the elongate pump chamber. Any four adjacent bladders in any length series of more than four bladders will have two operating as pinch valves and two operating as bladders. At the same time, one of the bladders acting as such expands in the elongate pump chamber to advance flow and the other acting as such retracts to receive flow. This operation then moves up one bladder unit at a time through the elongate pump chamber.

Figure 7:
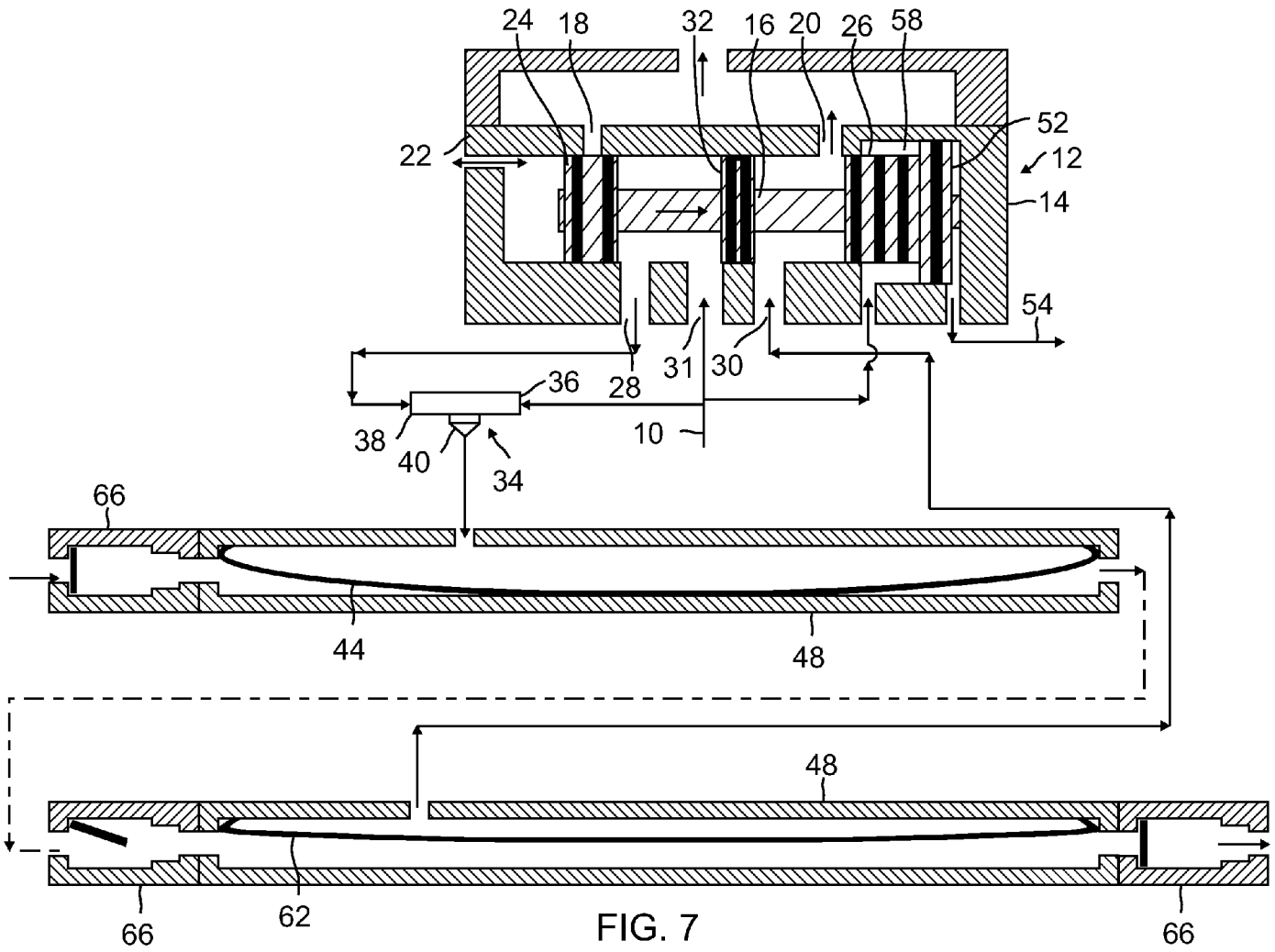
FIG. 7 is a schematic representation of an air operated pump as in FIG. 6 with one-way valves, the dotted line indicating a continuation of the elongate pump chamber.

FIG. 7 illustrates the device of FIG. 6 with passive one-way valves in the place of pinch valves illustrated in FIGS. 1-6. The control valve assembly and operation thereof for the bladders remains the same. Passive one-way valves 66 rely on initial closure bias forces or backflow for closure. This differs from active control employed in pinch valves and other pneumatically actuated valves. Pneumatic restrictions on flow to the bladder and an intermediate control valve position with pressure to all pneumatic elements are not of value with passive one-way valves.

A second embodiment of a pump is illustrated in FIGS. 8 through 11 in that the same control valve operates two or more separate lines. In this embodiment, the operation of the control valve 12 may be identical to the first embodiment. There are multiple elongate pump chambers 68, 70. One-way flap valves 72 are illustrated in the elongate pump chamber 70 while one-way ball valves 74 are illustrated in the elongate pump chamber 68 in FIGS. 8, 9 and 11. The different valve devices are shown in one embodiment to illustrate different possible mechanisms. It is anticipated that identical valves will be employed in both chambers 68, 70 in most such assemblies. Spring closures of the flaps 72 or balls 74 may be employed as needed. These one-way-valves 72, 74 replace the pinch valves illustrated in FIGS. 1 through 5 and do not require air control thereof in this embodiment.

Two venturi 76, 78 are employed to actuate the two bladders 80, 82. The same principle of venturi operation controlling the bladder 44 in the first embodiment is now employed to both expand and contract each bladder 80, 82 in FIGS. 8 and 9. To obtain alternate action between the chambers 68, 70, one of the two venturi 76, 78 is reversed in its attachment to the control valve 12, i.e., being attached to valve port 30 rather than valve port 28.

Figure 8:
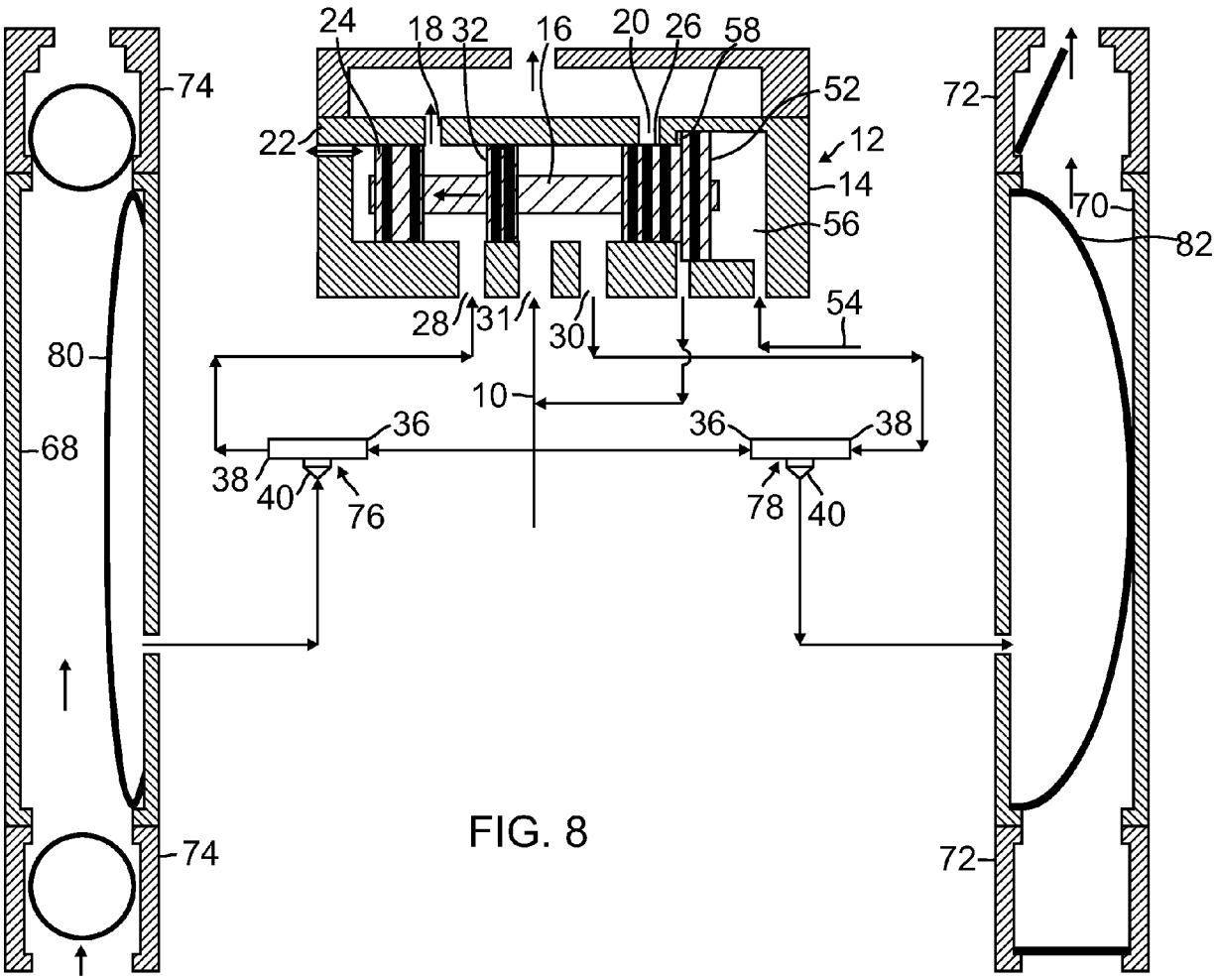
FIGS. 8 and 9 are schematic representations of a second embodiment of an air operated pump illustrating two control valve positions and showing separate pump chambers with two different one-way valves.
Figure 9:
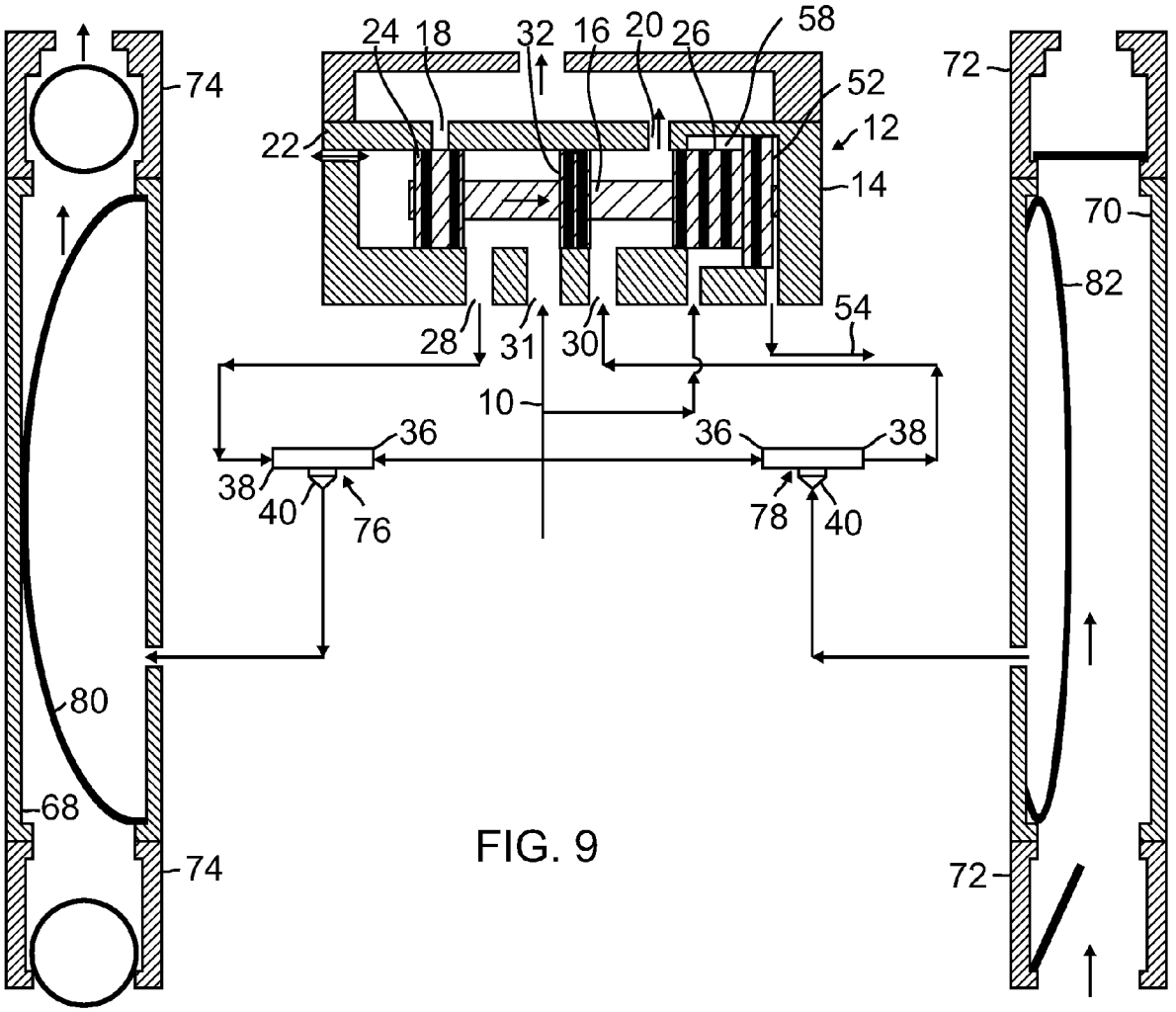
Figure 10:
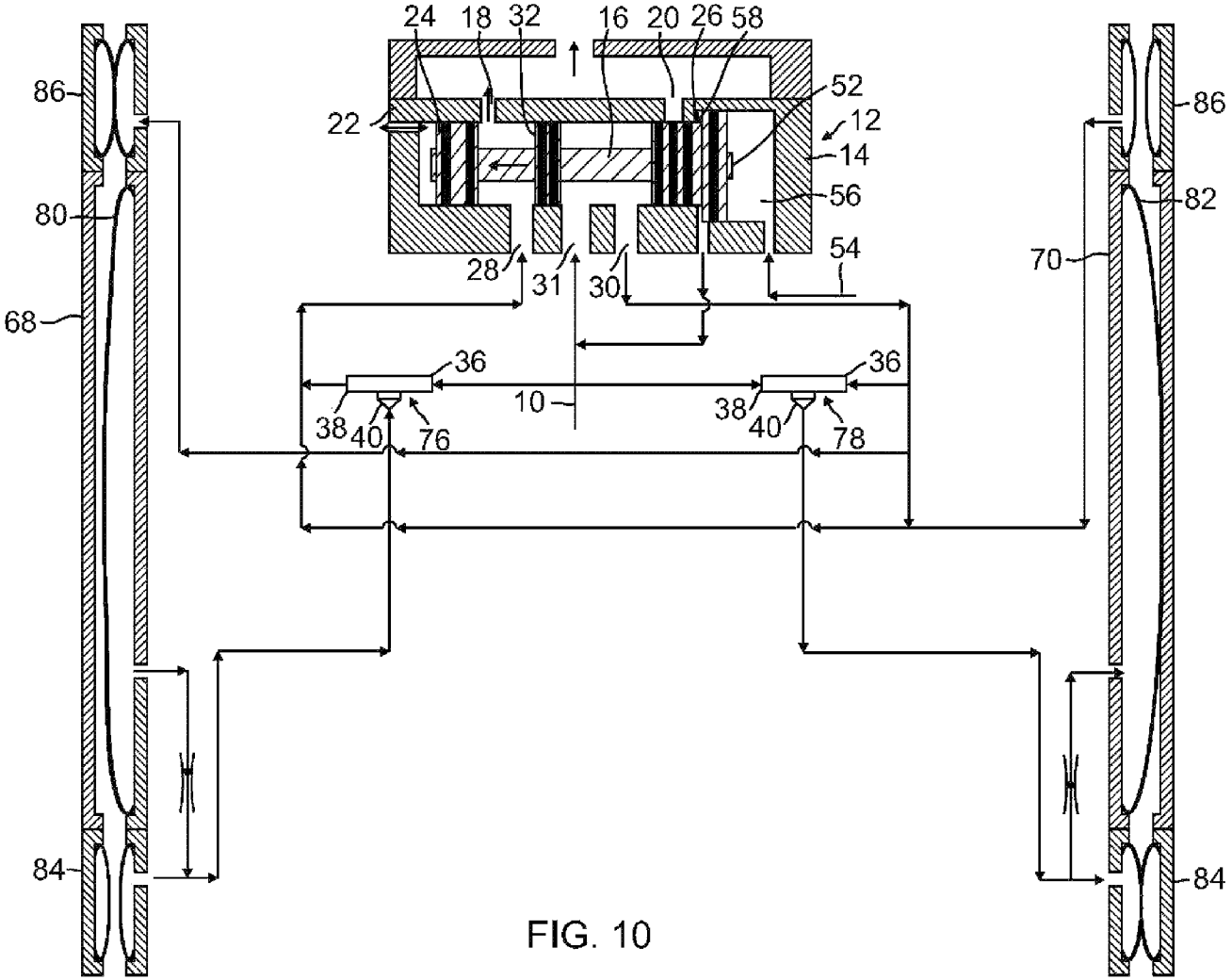
FIG. 10 is a schematic representation of an air operated pump as in FIGS. 8 and 9 with air actuated pinch valves.

FIG. 10 illustrates the same pump configuration as FIGS. 8 and 9 with the exchange of pinch valves 84, 86 in the place of the one-way valves 72, 74 at the inlets and outlets of the two chambers 68, 70. The control valve 12 and its operation remain the same as in the embodiment of FIGS. 1-5. The pneumatic system for the first chamber 68 is the same as described for the embodiment of FIGS. 1-5, as is the coupling of that system with the control valve 12. The pneumatic system for the second chamber 70 is also the same as described for the embodiment of FIGS. 1-5, as is the coupling of that system with the control valve 12 except that coupling with the valve ports 28 and 30 is reversed. In this way, the pump chambers 68, 70 operate 180° out of phase.

Figure 11:
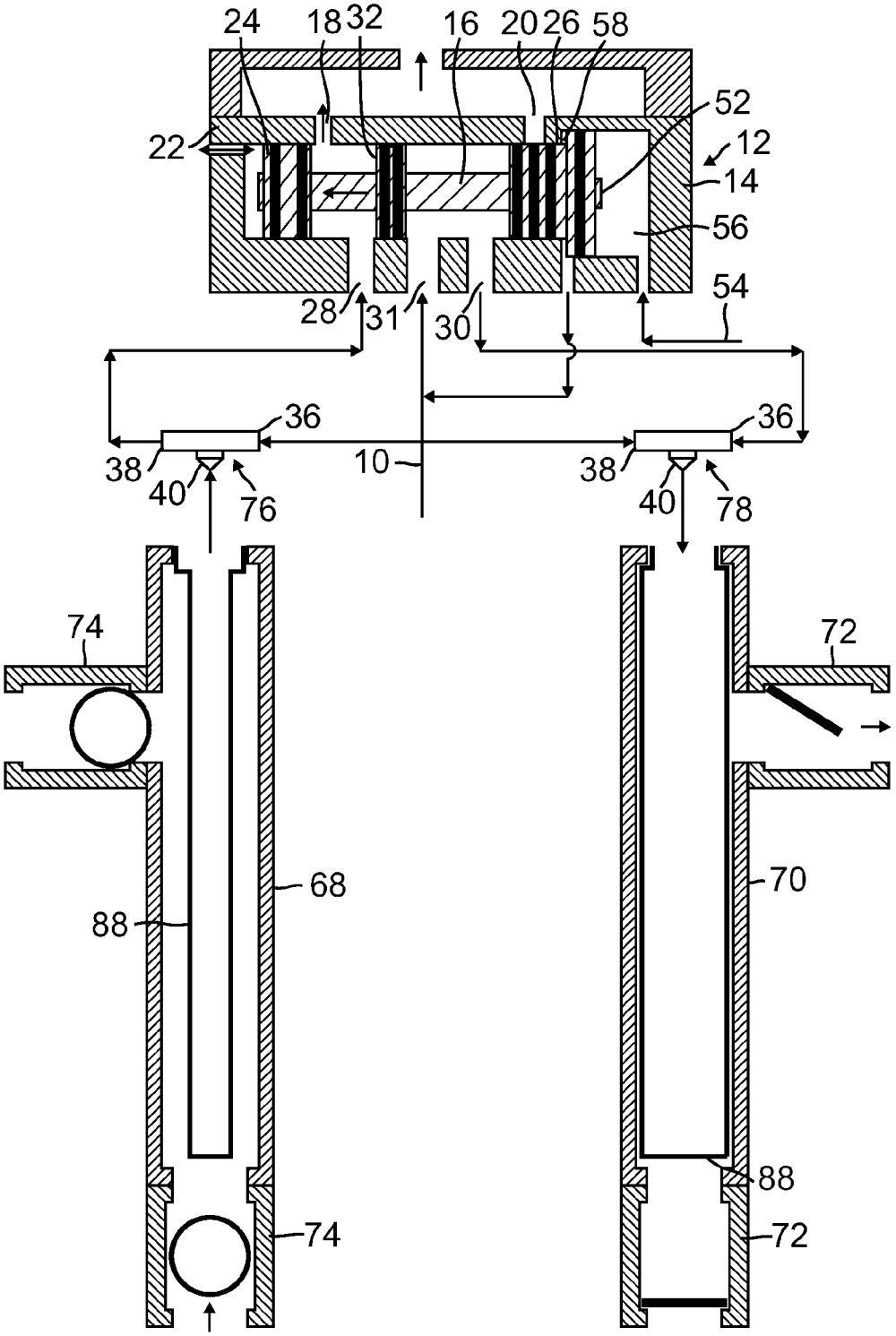
FIG. 11 is a schematic representation of an air operated pump as in FIGS. 8-9 with a different pump chamber embodiment and bladder.

The bladders in each of these embodiments may be as shown in FIGS. 1 through 10 or configured as shown in FIG. 11. All reference numbers in FIG. 11 reflect correspondence in function with elements so referenced in other figures. The bladder 88 in FIG. 11 is a flexible tube surrounded by pumped fluid. The bladder 88 is sealed at one end and anchored to an elongate pump chamber 68, 70 at the other end about an air port in communication with a venturi throat port 40. The downstream valve controlling the outlet of the elongate pump chamber 68, 70 may be moved to the side for simplicity and convenience of fabrication, yet remaining at the upper end of the bladder 88 with all of the valves disclosed herein being applicable to this configuration as well.

The components and configurations of any of the embodiments in FIGS. 1 through 11 may be substituted one for another if providing a similar function. For example, mixed use of one-way valves and pinch valves as well as exclusive use of either may be employed. Bladder configurations may be interchanged and air lines rerouted through the elongate pump chamber or chambers.

Thus, an air driven pump is disclosed which employs a bladder to propel fluid through an elongate chamber. While embodiments and applications of this invention have been shown and described, it would be apparent to those skilled in the art that many more modifications are possible without departing from the inventive concepts herein.

What is claimed is:

1. An air operated pump, comprising:

a source of compressed air;

an exhaust to atmosphere;

a first pump chamber including a first inlet and a first outlet;

a first valve controlling the first inlet of the first pump chamber;

a second valve displaced toward the first outlet from the first valve;

a first bladder in the first pump chamber between the first valve and the second valve;

a first venturi including an inlet end, an outlet end and a venturi throat port between the inlet end and the outlet end, the source of compressed air being in communication with the inlet end of the first venturi, the venturi throat port of the first venturi being in communication with the first bladder;

a control valve in communication with the source of compressed air, the exhaust to atmosphere and the outlet end of the first venturi, the control valve including a first position communicating the exhaust to atmosphere with the outlet end of the first venturi and a second position communicating the source of compressed air with the outlet end of the first venturi, the first valve being a first pinch valve and the second valve being a second pinch valve, the venturi throat port of the first venturi being in communication with the first pinch valve, the control valve being in communication with the second pinch valve, the first position of the control valve further communicating the source of compressed air with the second pinch valve and the second position of the control valve further communicating the exhaust to atmosphere with the second pinch valve.

2. The pump of claim 1, further comprising:

a second pump chamber including a second inlet and a second outlet;

a third pinch valve controlling the second inlet of the second pump chamber;

a fourth pinch valve in the second pump chamber and displaced toward the second outlet from the third valve;

a second bladder in the second pump chamber between the third and fourth pinch valves;

a second venturi including an inlet end, an outlet end and a venturi throat port, the source of compressed air being in communication with the inlet end of the second venturi, the venturi throat port of the second venturi being in communication with the second bladder, the control valve being in communication with the outlet end of the second venturi, the first position of the control valve communicating the source of compressed air with the outlet end of the second venturi and the second position of the control valve further communicating the exhaust to atmosphere with the outlet end of the second venturi, the venturi throat port of the second venturi being in communication with the third pinch valve, the control valve being in communication with the fourth pinch valve, the second position of the control valve further communicating the source of compressed air with the fourth pinch valve and the first position of the control valve further communicating the exhaust to atmosphere with the fourth pinch valve.

3. The pump of claim 1, further comprising a restriction in the communication between the venturi throat port of the first venturi and the first bladder, the communication between the venturi throat port of the first venturi with the first pinch valve being unrestricted.

4. The pump of claim 1, the control valve further including a third position between the first and second positions, the third position communicating the source of compressed air with the second pinch valve and with the outlet end of the first venturi.

5. The pump of claim 1, further comprising an alternating supply of pressurized air controlling the control valve to alternate between the first and second positions.

6. The pump of claim 1, further comprising:

a third pinch valve in the first pump chamber displaced toward the first outlet from the second pinch valve;

a second bladder in the first pump chamber between the first pinch valve and the third pinch valve, the control valve being in communication with the second bladder and the third pinch valve, the first position of the control valve further communicating the source of compressed air with the second bladder and the second position of the control valve further communicating the exhaust to atmosphere with the second bladder and the source of compressed air with the third pinch valve.

7. The pump of claim 6, further comprising an alternating supply of pressurized air controlling the control valve to alternate between the first and second positions.

8. The air operated pump of claim 1, the first pump chamber being elongate.

9. The pump of claim 8, the bladder being a sealed flexible tube within the first pump chamber, the first pump chamber further including an air port in communication with the sealed flexible tube, the air port being in an end of the elongate pump chamber, the outlet being on a side of the elongate pump chamber adjacent the air port.

10. The pump of claim 1, further comprising:

a third valve in the first pump chamber displaced toward the first outlet from the second pinch valve;

a second bladder in the first pump chamber, the second pinch valve being in the first pump chamber between the first bladder and the second bladder, the control valve being in communication with the second bladder, the first position of the control valve further communicating the source of compressed air with the second bladder and the second position of the control valve further communicating the exhaust to atmosphere with the second bladder.

11. The pump of claim 10, the third valve being open with the control valve in the first position and being closed with the control valve in the second position.

12. An air operated pump, comprising:

a source of compressed air;

an exhaust to atmosphere;

a first pump chamber including a first inlet and a first outlet;

a first pinch valve controlling the first inlet of the first pump chamber;

a second valve displaced toward the first outlet from the first pinch valve;

a first bladder in the first pump chamber between the first pinch valve and the second valve;

a first venturi including an inlet end, an outlet end and a venturi throat port between the inlet end and the outlet end, the source of compressed air being in communication with the inlet end of the first venturi, the venturi throat port of the first venturi being in communication with the first bladder and with the first pinch valve;

a control valve in communication with the source of compressed air, the exhaust to atmosphere and the outlet end of the first venturi, the control valve including a first position communicating the exhaust to atmosphere with the outlet end of the first venturi and a second position communicating the source of compressed air with the outlet end of the first venturi, the second valve being closed with the control valve in the first position and being open with the control valve in the second position.

13. The pump of claim 12, further comprising a restriction in the communication between the venturi throat port of the first venturi and the first bladder, the communication between the venturi throat port of the first venturi with the first pinch valve being unrestricted.

14. The pump of claim 12, further comprising an alternating supply of pressurized air controlling the control valve to alternate between the first and second positions.

15. The pump of claim 12, further comprising:

a second pump chamber including a second inlet and a second outlet;

a third pinch valve controlling the second inlet of the second pump chamber;

a fourth valve in the second pump chamber and displaced toward the second outlet from the third pinch valve;

a second bladder in the second pump chamber between the third pinch valve and the fourth valve;

a second venturi including an inlet end, an outlet end and a venturi throat port, the source of compressed air being in communication with the inlet end of the second venturi, the venturi throat port of the second venturi being in communication with the second bladder and the third pinch valve, the control valve being in communication with the outlet end of the second venturi, the first position of the control valve communicating the source of compressed air with the outlet end of the second venturi and the second position of the control valve further communicating the exhaust to atmosphere with the outlet end of the second venturi, the fourth valve being open with the control valve in the first position and being closed with the control valve in the second position.

16. The pump of claim 12, further comprising:

a third valve in the first pump chamber displaced toward the first outlet from the second valve;

a second bladder in the first pump chamber between the first pinch valve and the third valve, the control valve being in communication with the second bladder, the first position of the control valve further communicating the source of compressed air with the second bladder and the second position of the control valve further communicating the exhaust to atmosphere with the second bladder, the third valve being open with the control valve in the first position and being closed with the control valve in the second position.

17. The pump of claim 16, further comprising an alternating supply of pressurized air controlling the control valve to alternate between the first and second positions.

18. The pump of claim 12, the first pump chamber being elongate.

19. The pump of claim 18, the bladder being a sealed flexible tube within the first pump chamber, the first pump chamber further including an air port in communication with the sealed flexible tube, the air port being in an end of the elongate pump chamber, the outlet being on a side of the elongate pump chamber adjacent the air port.

* * * * *